US007612506B1

(12) United States Patent
Yang et al.

(10) Patent No.: US 7,612,506 B1
(45) Date of Patent: Nov. 3, 2009

(54) METHOD FOR CONTROLLING LIGHT-EMISSION OF A LIGHT-EMITTING DIODE LIGHT SOURCE

(75) Inventors: Tsung-Hsun Yang, Hsinchu (TW); Hung-Yu Chou, Kaohsiung (TW)

(73) Assignee: National Central University, Jhongli, Taoyuan County (TW)

( * ) Notice: Subject to any disclaimer, the term of this patent is extended or adjusted under 35 U.S.C. 154(b) by 16 days.

(21) Appl. No.: 12/149,813

(22) Filed: May 8, 2008

(51) Int. Cl.
*H05B 37/00* (2006.01)

(52) U.S. Cl. ..... 315/291; 315/307; 315/309

(58) Field of Classification Search ..... 315/186, 315/185 R, 192, 191, 291, 307, 308, 309, 315/312, 313, 310, 311
See application file for complete search history.

(56) References Cited

U.S. PATENT DOCUMENTS 6,465,967 B2 * 10/2002 Tsujikawa et al. ..... 315/169.1
6,864,641 B2 * 3/2005 Dygert ..... 315/216
6,975,079 B2 12/2005 Lys et al.
7,132,805 B2 11/2006 Young
7,262,559 B2 * 8/2007 Tripathi et al. ..... 315/291
2006/0022614 A1 2/2006 Young

OTHER PUBLICATIONS

S.C. Bera et al., "Temperature Behavior and Compensation of Light-Emitting Diode", IEEE Photonics Technology Letters, vol. 17, No. 11, Nov. 2005, pp. 2286-2288.
Y. Xi et al., "Junction-Temperature Measurement in GaN Ultraviolet Light-Emitting Diodes Using Diode Forward Voltage Method", Applied Physics Letters, vol. 85, No. 12, Sep. 20, 2004, pp. 2163-2165.

* cited by examiner

*Primary Examiner*—David Hung Vu
(74) *Attorney, Agent, or Firm*—Stites & Harbison PLLC; Juan Carlos A. Marquez, Esq.

(57) ABSTRACT

A method for controlling light-emission of a light-emitting diode (LED) light source whose heat is dissipated by a thermal module is provided. The method includes following steps: providing a constant current source to drive the LED light source and obtaining a reference voltage correspondingly; monitoring and obtaining a dynamic voltage of the LED light source; and comparing the dynamic voltage with the reference voltage and adjusting a heat-dissipating power of the thermal module in real time to make the dynamic voltage of the LED light source approach the reference voltage. By monitoring the dynamic voltage of the LED light source and adjusting the heat-dissipating power of the thermal module in real time, light power of the LED light source can be maintained.

4 Claims, 3 Drawing Sheets

METHOD FOR CONTROLLING LIGHT-EMISSION OF A LIGHT-EMITTING DIODE LIGHT SOURCE

BACKGROUND OF THE INVENTION

1. Technical Field

The present invention relates to a method for controlling light-emission of a light-emitting diode (LED) light source, and more particularly, to a method for controlling light-emission of an LED light source by adjusting a heat-dissipation power of a thermal module in real time.

2. Description of Related Art

With the development of the photoelectric industry, there has been a trend to replace conventional light sources with LEDs, but the light power of LEDs must be increased and kept stable to meet practical needs. However, heat is generated and accumulated when an LED is turned on for a long time, resulting in a higher junction temperature and a lower luminous efficacy of the LED. As a result, light power of the LED will continue to decrease and cannot be maintained stable.

In order to stabilize the light power of LEDs, a variety of optical sensors, temperature sensors, voltage sensors, etc. have been incorporated into LED light source driving modules, so as to drive and monitor the LEDs in real time, thereby maintaining the light power of the LEDs.

For example, U.S. Pat. No. 7,132,805 uses a temperature sensor, a current waveform sensor and a voltage differential sensor to monitor working characteristics, such as a working temperature, a working current, etc., of an LED and adjust an input current in real time, so as to maintain the light power of the LEDs.

In addition, U.S. Patent Published Application No. 2006/0022614 A1 uses a color optical sensor and a temperature sensor for monitoring an illumination color and a working temperature of LEDs in real time, respectively. The LEDs can be disposed on a heat-dissipation device and combined with a feedback mechanism, allowing a heat-dissipation power of the heat-dissipation device to be adjusted as the temperature sensor monitors the working temperature of the LEDs in real time. Therefore, heat generated by the LEDs can be dissipated in real time to maintain light power of the LEDs.

However, the aforementioned LED light source driving modules must work with various optical sensors, temperature sensors, voltage sensors and so on, which not only complicate structures of the LED light source driving modules, but also significantly increase their production costs. Moreover, the control methods employed are also very complicated.

SUMMARY OF THE INVENTION

The present invention relates to a method for controlling light-emission of an LED light source, wherein a dynamic voltage of the LED light source is monitored in real time so as to detect a change in a junction temperature of the LED light source and to adjust a heat-dissipation power of a thermal module. Thus, heat generated by the LED light source can be dissipated in real time, allowing the dynamic voltage of the LED light source to approach a reference voltage, so that light power of the LED light source can be maintained. The present invention can simplify a structure of a conventional LED light source driving module and thereby lower its production cost.

To achieve this end, the present invention provides a method for controlling light-emission of an LED light source whose heat is dissipated by a thermal module. The method comprises following steps: providing a constant current source to drive the LED light source and obtaining a reference voltage corresponding to a drive current generated by the constant current source; monitoring and obtaining a dynamic voltage across two electrodes of the LED light source; and comparing the dynamic voltage with the reference voltage and adjusting a heat-dissipating power of the thermal module time to make the dynamic voltage of the LED light source approach the reference voltage.

In the method disclosed above, the LED light source can be a single LED or a combination of a plurality of LEDs.

In the method disclosed above, the dynamic voltage can be obtained via a voltage-sensing unit while the dynamic voltage can be a forward voltage of the LED light source. The heat-dissipation power of the thermal module is decreased if the dynamic voltage is higher than the reference voltage, and increased if the dynamic voltage is lower than the reference voltage.

The present invention can be implemented to provide at least the following advantageous effects:

1. The method for controlling the LED light source is simplified while the light power of the LED light source is maintained;
2. By controlling the dynamic voltage of the LED light source in real time, additional sensors can be spared to simplify an LED light source driving module structurally; and
3. By minimizing the number of additional sensors, the production cost of the LED light source driving module can be lowered.

A detailed description of further features and advantages of the present invention is given below, so that a person skilled in the art is allowed to understand and carry out the technical content of the present invention, and can readily comprehend the objectives and advantages of the present invention by reviewing the content disclosed herein, the appended claims and the accompanying drawings.

BRIEF DESCRIPTION OF THE DRAWINGS

The invention as well as a preferred mode of use, further objectives and advantages thereof will best be understood by reference to the following detailed description of an illustrative embodiment when read in conjunction with the accompanying drawings, wherein.

DETAILED DESCRIPTION OF THE PREFERRED EMBODIMENT

Figure 1A:
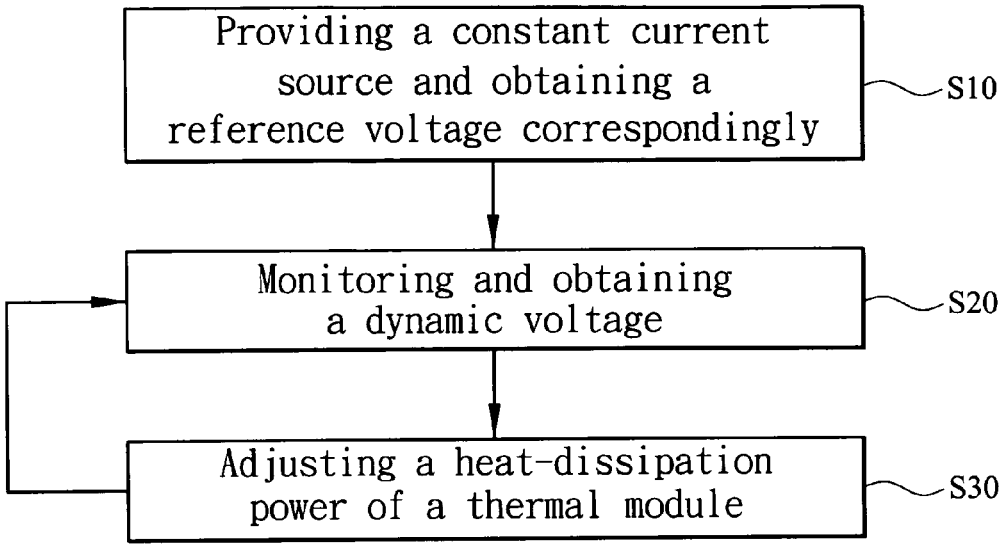
FIG. 1A is a flow chart of a method for controlling light-emission of an LED light source according to the present invention.

Referring to FIG. 1A, according to a preferred embodiment of the present invention, a method for controlling light-emission of an LED light source whose heat is dissipated by a thermal module allows real-time dissipation of heat accumulated in the LED light source. The method comprises the following steps: providing a constant current source and obtaining a reference voltage correspondingly (step S10); monitoring and obtaining a dynamic voltage (step S20); and adjusting a heat-dissipation power of the thermal module (step S30).

In the step S10 of providing the constant current source and obtaining the reference voltage correspondingly, the LED light source is driven by the constant current source to emit light, and a reference voltage $V_0$ is obtained with a drive current generated by the constant current source. The LED light source can be a single LED or a combination of a plurality of LEDs, wherein an illumination wavelength of the LED light source can range from 380 nm to 800 nm but is not limited thereto.

In the step S20 of monitoring and obtaining a dynamic voltage, a voltage-sensing unit can be used to monitor a voltage across two electrodes of the LED light source and thereby obtain a dynamic voltage $V_D$. Since the dynamic voltage $V_D$ has a linear relationship with a junction temperature of the LED light source, a change in the junction temperature can be detected by monitoring the dynamic voltage $V_D$ in real time.

More particularly, a rise in the junction temperature of the LED light source implies that part of an input power has converted into heat energy, thereby reducing a light power of the LED light source. On the contrary, a drop in the junction temperature of the LED light source signifies that part of the input power has converted into light energy, so that the light power of the LED light source is increased. Since the dynamic voltage $V_D$ of the LED light source changes with the junction temperature and the light power of the LED light source, a change in the junction temperature and the light power of the LED light source can be monitored by directly monitoring the dynamic voltage $V_D$ of the LED light source.

Figure 1B:
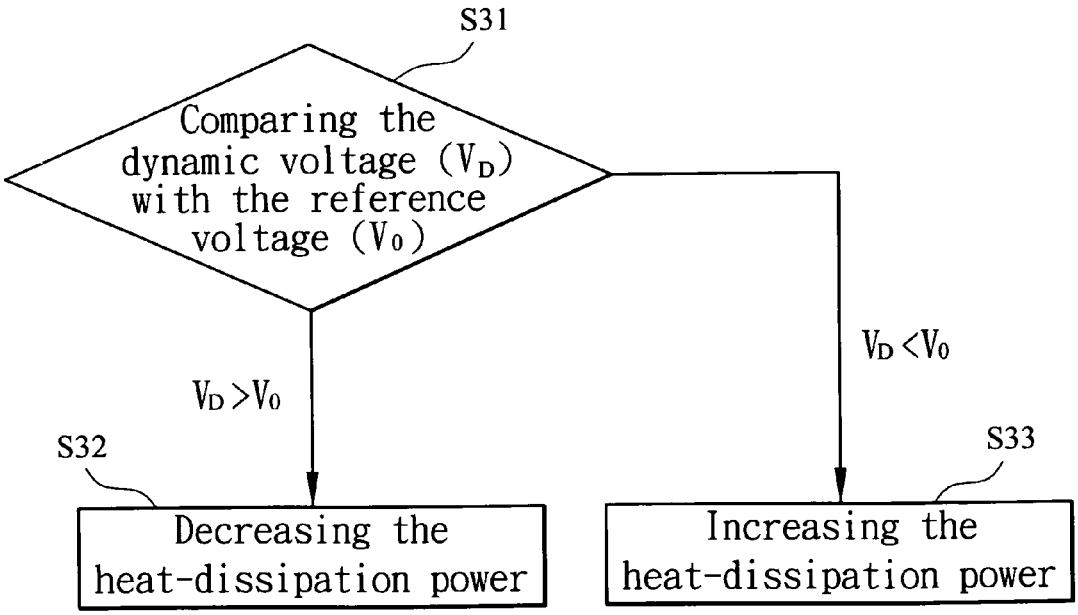
FIG. 1B is a flow chart of a method for adjusting a heat-dissipation power of a thermal module according to the present invention.

Referring to FIG. 1B, the step S30 of adjusting the heat-dissipation power of the thermal module can be further divided into three sub-steps, which comprise: comparing the dynamic voltage with the reference voltage (sub-step S31); decreasing the heat-dissipation power (sub-step S32); and increasing the heat-dissipation power (sub-step S33).

In the sub-step S31 of comparing the dynamic voltage with the reference voltage, the dynamic voltage $V_D$ is compared with the reference voltage $V_0$, so as to determine whether or not the junction temperature and the light power of the LED light source have changed. Since the heat generated by the LED light source can be dissipated by thermal module in real time to lower the junction temperature of the LED light source, the heat-dissipation power of the thermal module can be adjusted according to a comparison result between the dynamic voltage $V_D$ and the reference voltage $V_0$, so that the dynamic voltage $V_D$ approaches the reference voltage $V_0$, thereby maintaining the light power of the LED light source.

In the sub-step S32 of decreasing the heat-dissipation power, if the dynamic voltage $V_D$ is a forward voltage of the LED light source and higher than the reference voltage $V_0$ ($V_D>V_0$), then the junction temperature of the LED light source has dropped as the light power of the LED light source increased. Therefore, by decreasing the heat-dissipation power of the thermal module, the light power of the LED light source can be reduced and restored to the initial level.

In the sub-step S33 of increasing the heat-dissipation power, if the dynamic voltage $V_D$ is a forward voltage of the LED light source and lower than the reference voltage $V_0$ ($V_D<V_0$), the junction temperature of the LED light source has risen as the light power of the LED light source decreased. Therefore, by increasing the heat-dissipation power of the thermal module to lower the junction temperature, the light power of the LED light source can be raised and restored to the initial level.

Figure 2:
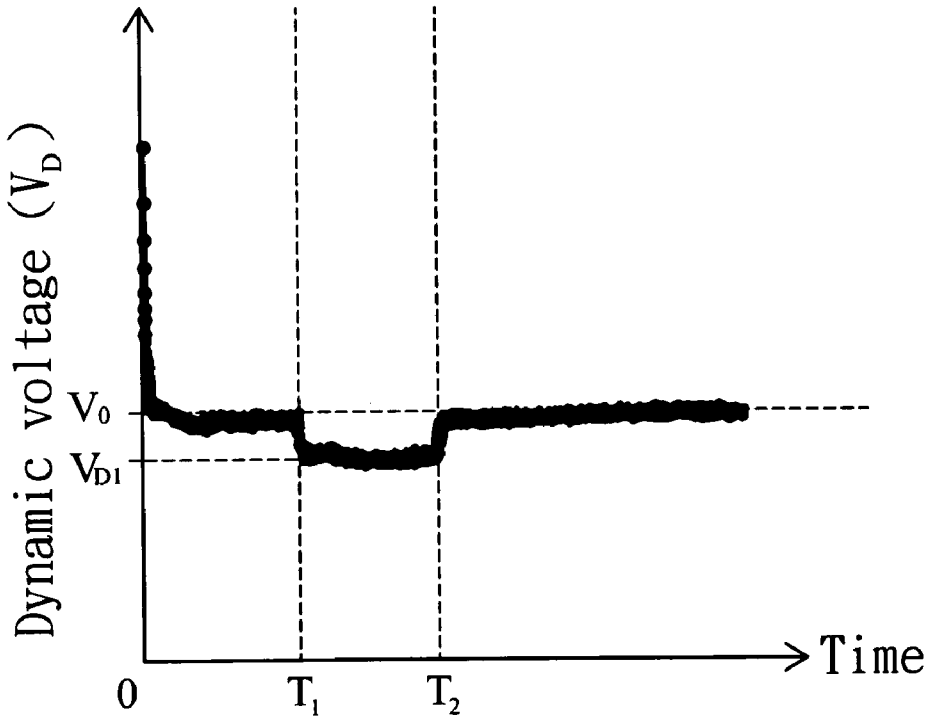
FIG. 2 shows a dynamic voltage plot in which the dynamic voltage is plotted against time before and after implementing the present invention.
Figure 3:
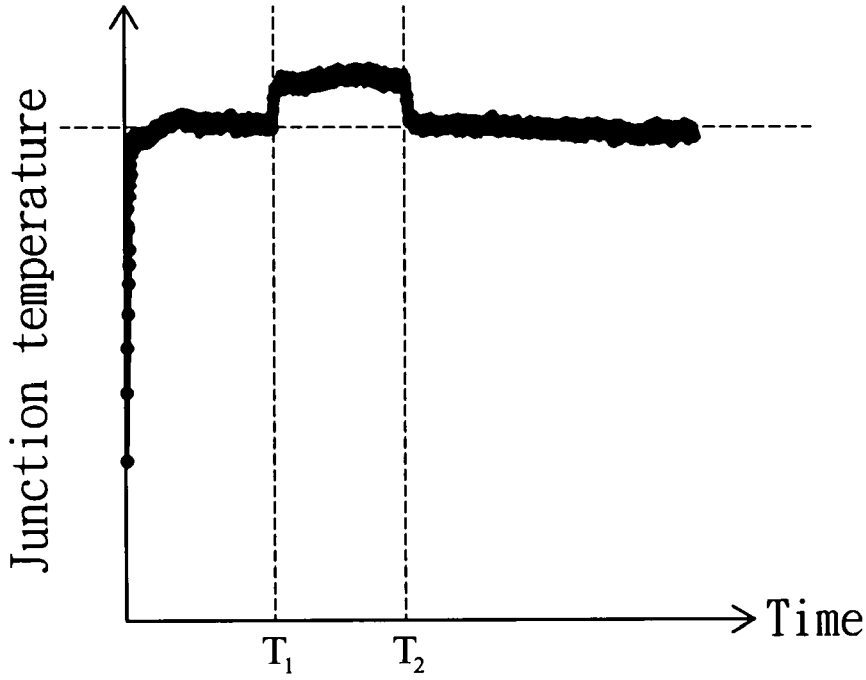
FIG. 3 shows a junction temperature plot in which the junction temperature is plotted against time before and after implementing the present invention.
Figure 4:
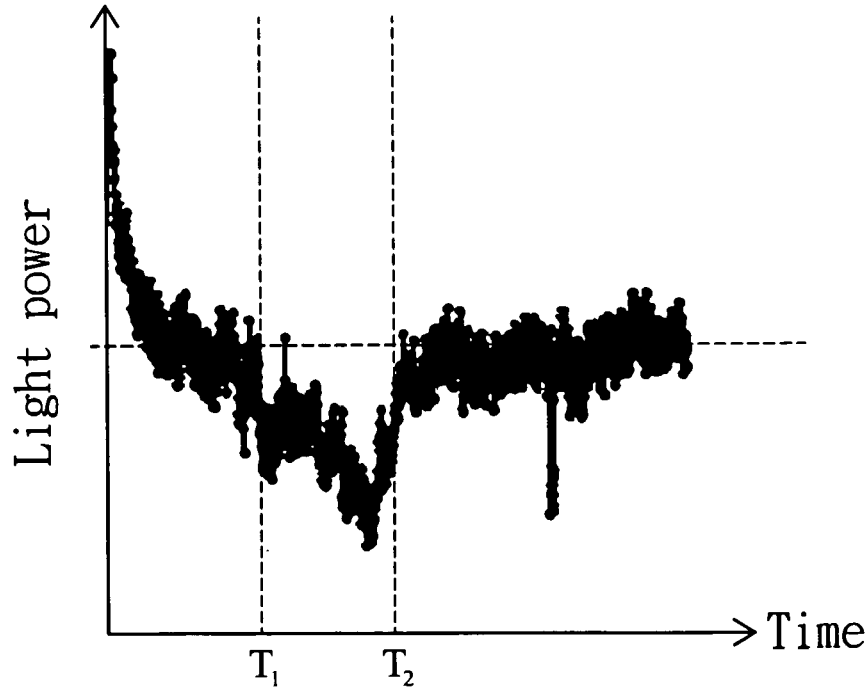
FIG. 4 shows a light power plot in which the light power is plotted against time before and after implementing the present invention.

For example, as shown in FIGS. 2, 3 and 4, when the dynamic voltage $V_D$ is a forward voltage, a dynamic voltage $V_{D1}$ within a period between a first time point $T_1$ and a second time point $T_2$ is lower than the reference voltage $V_0$. This implies that the junction temperature of the LED light source has risen while the light power of the LED light source decreased. By increasing the heat-dissipation power of the thermal module, the junction temperature is allowed to fall, so that the dynamic voltage $V_D$ of the LED light source approaches the reference voltage $V_0$. As a result, the light power of the LED light source is raised and restored to the initial level after the second time point $T_2$.

Contrarily, a rise of the dynamic voltage $V_D$ of the LED light source beyond the reference voltage $V_0$ implies that the junction temperature of the LED light source has fallen while the light power of the LED light source increased. Therefore, by decreasing the heat-dissipation power of the thermal module, the heat generated by the LED light source will be accumulated to increase the junction temperature. As a result, the light power of the LED light source is reduced and restored to the initial level.

As shown in FIG. 1A, with the preferred embodiment of the present invention, the dynamic voltage $V_D$ can be constantly monitored and obtained, allowing the change in the junction temperature of the LED light sources to be monitored in real time. Thus, the heat-dissipation power of the thermal module can be adjusted in real time to make the dynamic voltage $V_D$ of the LED light source approach the reference voltage $V_0$, thereby maintaining the light power of the LED light source.

The features of the present invention have been described with the preferred embodiment thereof and it is understood that the embodiment is intended to enable a person skilled in the art to understand and carry out the content of the present invention but not intended to limit the scope of the present invention. Therefore, all equivalent changes or modifications that do not depart from the spirit of the present invention as disclosed herein should be encompassed by the appended claims.

What is claimed is:

1. A method for controlling light-emission of a light-emitting diode (LED) light source, the LED light source undergoing heat dissipation through a thermal module, the method comprising steps of:

providing a constant current source to drive the LED light source, and obtaining a reference voltage corresponding to a drive current generated by the constant current source;

monitoring and obtaining a dynamic voltage across two electrodes of the LED light source; and comparing the dynamic voltage with the reference voltage and adjusting a heat-dissipation power of the thermal module to make the dynamic voltage approach the reference voltage.

2. The method as claimed in claim 1, wherein the LED light source is a single LED or a combination of a plurality of LEDs.

3. The method as claimed in claim 1, wherein the dynamic voltage is obtained via a voltage-sensing unit.

4. The method as claimed in claim 1, wherein the dynamic voltage is a forward voltage of the LED light source, and the heat-dissipation power is decreased if the dynamic voltage is higher than the reference voltage, and increased if the dynamic voltage is lower than the reference voltage.

* * * * *